United States Patent [19]

Stoll

[11] 4,434,555

[45] Mar. 6, 1984

[54] CUTTER FOR FLEXIBLE PIPES

[76] Inventor: Kurt Stoll, Lenzhalde 72, 7300 Esslingen, Fed. Rep. of Germany

[21] Appl. No.: 361,636

[22] Filed: Mar. 25, 1982

[51] Int. Cl.[3] ..... B26B 17/00

[52] U.S. Cl. ..... 30/92; 30/179; 30/258

[58] Field of Search ..... 30/92, 186, 258, 191, 30/193, 90.1, 188, 250, 252

[56] References Cited

U.S. PATENT DOCUMENTS

| | | | |
|---|---|---|---|
| 530,221 | 12/1894 | Effinger | 30/188 |
| 3,772,783 | 11/1973 | Averitt | 30/186 |
| 4,336,652 | 6/1982 | Robertson | 30/258 |

FOREIGN PATENT DOCUMENTS

| | | | |
|---|---|---|---|
| 963076 | 5/1957 | Fed. Rep. of Germany | 30/92 |

*Primary Examiner*—Jimmy C. Peters

*Attorney, Agent, or Firm*—Flynn, Thiel, Boutell & Tanis

[57] ABSTRACT

A tongs- or pliers-like cutter has one head end of decreased thickness with a pointed, plate-like cutting blade thereon and an opposite forked head end such that the pointed cutting blade may be moved into the space between the two prongs of the fork. As seen from the side, these prongs are furthermore shaped in a manner complementary to the pointed shape of the cutting blade. The two head ends may furthermore have inwardly narrowing holes for chamfering off the ends of cut flexible tube.

15 Claims, 5 Drawing Figures

CUTTER FOR FLEXIBLE PIPES

FIELD OF THE INVENTION

The present invention relates to a tongs-like cutter and, more particularly, to a cutter for use on pipes and tubes made of flexible material, as for example plastic or rubber, and made up of two crossed-over levers having head ends and having tail ends which may be gripped in the hand for levering the head ends together so that the material may be cut between them.

SUMMARY OF THE INVENTION

One purpose of the present invention is that of designing a cutter of the sort noted which is light in weight and readily used and is trouble-free in its cutting function. A further purpose of the invention is that of designing such a cutter with a cutting blade which may be changed over simply and quickly.

For effecting these and further purposes of the invention, the cutter is so designed that one head end has a cutter blade placed flatly against it on one side and kept in position by, for example, screws so that it may be taken off again, while the other head end of the cutter has a hollow opposite to the cutter blade and into which the blade may be moved, at least in part, on pushing the two head ends together.

The design may be such that the free end of the head end with the cutter blade is less thick, for example half as thick, as the rest of the lever, and is in the form of a sort of shelf at such head end, onto which the cutter blade may be placed. The cutter blade may for example be made five-sided, having a point running generally symmetrically towards the other head end, and the cutting point having an angle, at which its two sides converge, of more than 90° as part of the five-sided figure. The design may for example be such that the free end of the head end with the hollow has such a shape that it is equal and opposite to the shape of the cutter blades' point. The length of the hollow as measured at the tip of the head end is greater than the height of the cutter blade. The outcome is a cutter which is very simple in use and readily handled, one more specially important point of its design being that the cutter blades may be simply fixed in position and taken off again for changing them over. Furthermore, the general structure of the cutter is simple so that it may be produced at a generally low price.

A further point is that each head end may have a hole in one of its flat sides, that is to say on one of its sides in a plane normal to a pivot pin by which the two levers are pivotally joined together. Such holes become narrower in an inward direction in the form of a cone and may be present on opposite sides of the two head ends. The cutter, with such holes, may be used for chamfering the ends of pipes by forcing a pipe end into one narrowing hole and twisting it. In this way assembly with plug-in screw unions is made simpler.

Cutters of the sort in question may be used for cutting off lengths of plastic or rubber pipe with and without textile reinforcements.

BRIEF DESCRIPTION OF THE DRAWINGS

One working example of the invention will be seen in the figures.

DETAILED DESCRIPTION

Figure 1A:
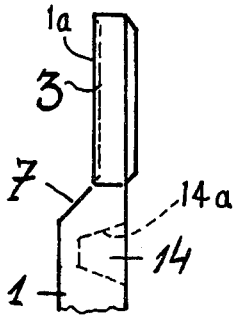
FIG. 1*a* is a view of the head end of one of the levers of the cutter of FIG. 1, seen looking in the direction of the arrow I.
Figure 1:
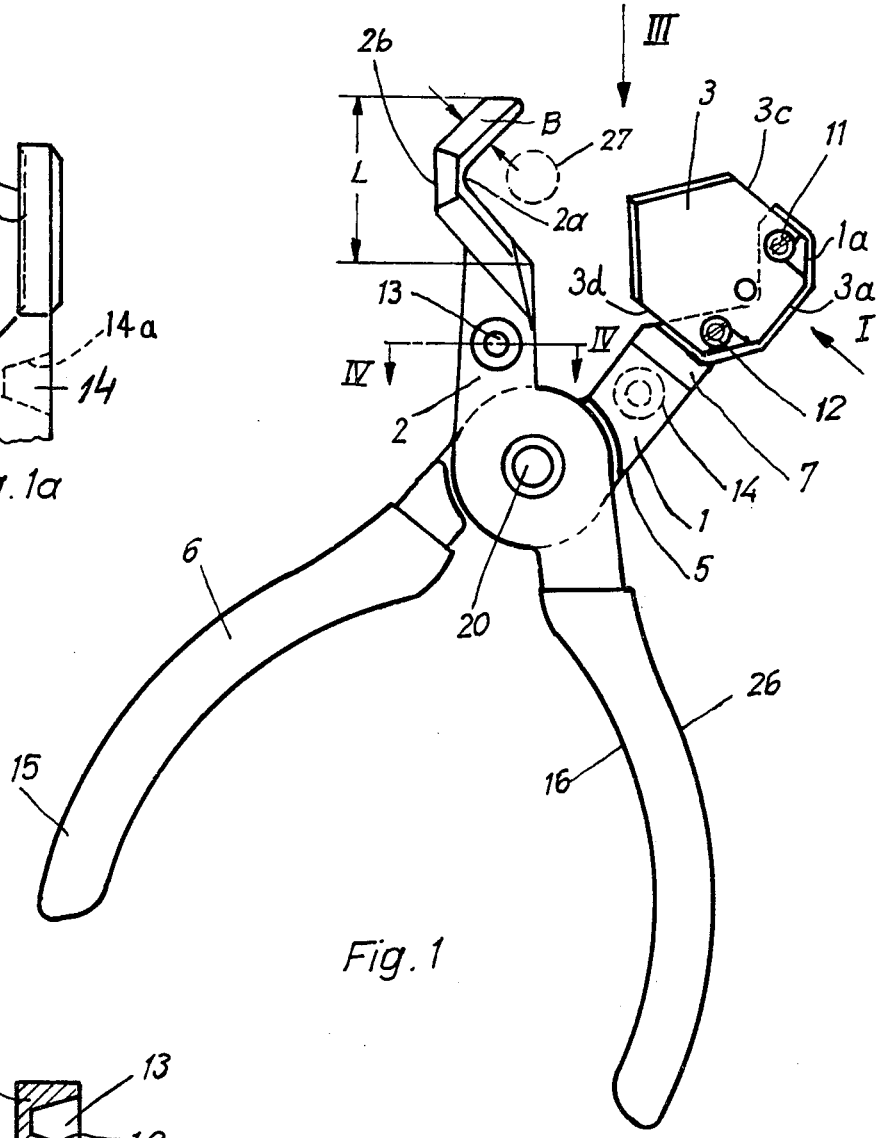
FIG. 1 is a full elevational side view of a cutter tool embodying the invention.

The cutter of the present invention is generally tongs-like and is made up of two elongate crossed-over tongs parts or levers 6, 26, joined together at their crossing point by a pivot pin 20 so that they may be turned about such pin 20 with a levering effect. The lower or tail ends 15 and 16 are handles designed for being gripped in the hand and pushed together, while the top or head ends 1 and 2 are in the form of cutting jaws which can be moved between a closed position adjacent each other and an open position (FIG. 1) spaced from each other. The cutter is generally so designed that material to be cut, marked at 27, is placed between the head ends and may be cut by pivoting the two levers so that the two head ends 1 and 2 move together.

Figure 3:
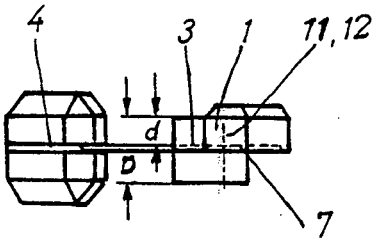
FIG. 3 is a view of the end part of the cutter, looking in the direction of the arrow III in FIG. 1, only some of the parts thereof being seen.

As part of the invention, the head end 1 has a cutting blade 3 placed against a flat surface thereof, see more specially FIG. 3. The blade is fixed on the head end 1 by screws 11 and 12 having shanks which threadedly engage openings in the head end 1 and having heads which force the cutting blade 3 against the head end 1. The other head end 2 has a V-shaped anvil surface 2*a* with a hollow or slot 4 therein opposite to the cutting blade and into which the cutting blade 3 is pushed, at least in part, as the two head ends are forced together. Generally, in connection with fixing the blade in position and making such a fixing operation as simple as possible, the head end 1 with the blade 3 thereon is made less thick, in the form of a sort of shelf, than the rest 5 of the lever 6. Putting it differently, it may be said that the relation between the two thicknesses d (thickness of the shelf) and D (thickness of the rest of the lever) is about 1 to 2 so that there is a sort of offset part 7 at the head end 1 which is geared to the size, and more specially the thickness, of the cutting blade 3 and is disposed on one side of the blade 3; see in this connection FIG. 1*a*.

Figure 2:
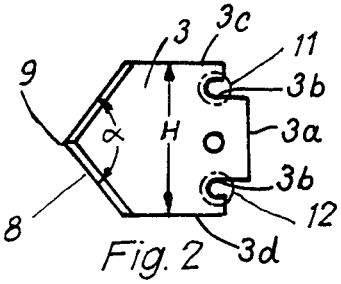
FIG. 2 is a side view of a blade for use in the cutter of FIG. 1.

It will be seen from FIG. 2 that the cutting blade 3 is five-sided or pentagonal, its one point or corner 9 being directed towards the hollow or slot 4 of the other head end and running generally symmetrically towards the other head end 2. The cutting edge 8, in the narrow sense of word, is formed by the two sides of the pentagon which converge towards point 9. The cutting edge may best have an angle ($\alpha$) of more than 90°.

As shown in FIG. 2, the blade 3 has therein, at each end of the edge 3*a* which is opposite the cutting edge 8, a recess 3*b* which receives the shank of a respective one of the screws 11 and 12. The head end 1 has a rib 1*a* thereon (FIGS. 1 and 1*a*) which engages the edges 3*a*, 3*c* and 3*d* of the blade 3.

The outer end of the head end 2 with the anvil surface 2*a* thereon has a shape (see more specially FIG. 1) which is equal and adjacent to the opposite part of the cutting blade. The length L of the hollow 4, measured from the tip of the head end 2, is greater than the height H of the cutting blade, or putting it differently L is greater than H. The hollow 4 goes all the way through the head end 2 from side to side, its length being equal to the breadth B of the head end 2, the hollow stretching as a slot from the side 2*a* to the side 2*b* of the head end 2, to give a two-pronged or two-armed fork structure each arm being generally V-shaped.

Figure 4:
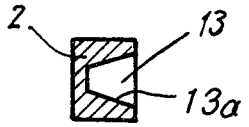
FIG. 4 is a section on the line IV—IV of FIG. 1.

Furthermore, each head end 1 and 2 has on one of its flat sides a narrowing or coned hole 13 and 14, whose shape will be seen more specially from FIG. 4. The holes 13 and 14 open on opposite sides of the two head ends 1 and 2 (see FIG. 1) and have abrasive frusto-conical surfaces 13*a* and 14*a* which are used for chamfering the ends of tubes or hose of the sort to be cut with the cutter. For such chamfering, the tube end is pushed into one of the narrowing holes and twisted backwards and forwards so that it takes on a coned or somewhat pointed form, this making for simpler assembly of such pipe ends, for example using screw plugging connections.

The shape of the cutter blade and the way it is placed on its head end make it possible for it to be put into position and taken off again very simply and quickly.

The levers 6 and 26 are made up of a light alloy or synthetic resin, while the cutting blade 3 is made up of a special-purpose steel. The tail ends or handles 15, 16 of the two levers are covered with synthetic resin or plastic so that the cutter is readily used and handled because the covers on its tail ends and because of its low weight.

The embodiments of the invention in which an exclusive property or privilege is claimed are defined as follows:

1. A hand-held cutting tool, comprising elongate first and second members and a blade; said first and second members being pivotally coupled to each other between their ends and being pivotal relative to one another about an axis; one end of each said member being a handle and the other end thereof being a jaw, said jaws being moved between a closed position adjacent each other and an open position spaced from each other in response to relative pivotal movement of said first and second members; said blade being releasably secured to said jaw of said first member, projecting therefrom toward said jaw of said second member, and having a cutting edge facing said jaw of said second member; said jaw of said second member having means defining a V-shaped surface which faces and opens toward said blade and which has therein a deep, elongate slot which is parallel to and receives said blade in said closed position of said jaws; and said jaw of said first member being disposed on one side of said blade, having a flat surface against which said blade is disposed, having means defining a threaded opening in said flat surface, and including a screw which has a threaded shank engaging said threaded opening and a head disposed against a side of said blade remote from said flat surface, said blade being securely clamped between said flat surface and said head of said screw.

2. The tool according to claim 1, wherein one of said first and second members has means defining an opening therein which tapers inwardly and has an abrasive surface.

3. The tool according to claim 2, wherein said first and second members each have means defining a said tapered opening therein.

4. The tool according to claim 2, wherein said tapered opening is a blind hole.

5. The tool according to claim 1, wherein said blade has approximately the shape of a pentagon, said cutting edge thereof being defined by two adjacent sides of said pentagon which converge at an angle of more than 90° to a tip which projects toward said V-shaped surface on said jaw of said second member, said V-shaped surface having a shape substantially complementary to the shape of said cutting edge of said blade.

6. The tool according to claim 5, including a rib which is provided on said jaw of said first member and engages an edge of said blade opposite said cutting edge thereof.

7. The tool according to claim 5, wherein said jaw of said first member includes two said threaded openings in said flat surface at spaced locations and two said screws which each have a said threaded shank engaging a respective said threaded opening, and wherein said blade has two recesses therein at spaced locations along an edge thereof opposite said cutting edge, each said recess receiving said shank of a respective said screw therein.

8. The tool according to claim 1, wherein said blade and said slot each lie in a plane which is substantially perpendicular to said axis about which said first and second members are supported for relative pivotal movement.

9. The tool according to claim 1, wherein said slot extends completely through said jaw of said second member.

10. The tool according to claim 1, wherein said jaw of said second member includes two spaced, substantially parallel arms which project outwardly in a direction away from said axis about which said first and second members pivot, said arms each having thereon a respective V-shaped portion of said V-shaped surface, and said slot in said V-shaped surface being the region between said arms.

11. The tool according to claim 10, wherein each of said arms is generally V-shaped.

12. The tool according to claim 1, including a coating of synthetic resin on said handle of each of said first and second members.

13. The tool according to claim 1, wherein said first and second members are each made of a light alloy and said blade is made of a steel.

14. The tool according to claim 1, wherein said first and second members are each made of a synthetic resin and said blade is made of a steel.

15. A hand-held cutting tool, comprising elongate first and second members and a blade; said first and second members being pivotally coupled to each other between their ends and being pivotal relative to one another about an axis; one end of each said member being a handle and the other end thereof being a jaw, said jaws being moved between a closed position adjacent each other and an open position spaced from each other in response to relative pivotal movement of said first and second members; said blade being releasably secured to said jaw of said first member, projecting therefrom toward said jaw of said second member, and having a cutting edge facing said jaw of said second member; said jaw of said second member having means defining a V-shaped surface which faces and opens toward said blade and which has therein a deep, elongate slot which is parallel to and receives said blade in said closed position of said jaws; said jaw of said first member being disposed on one side of said blade, having a flat surface against which said blade is disposed, having means defining a threaded opening in said flat surface, and including a screw which has a threaded shank engaging said threaded opening and a head disposed against a side of said blade remote from said flat surface, said blade being securely clamped between said flat surface and said head of said screw; and one of said first and second members having means defining an opening therein which tapers inwardly and has an abrasive surface.

* * * * *